US010187737B2

(12) United States Patent
Chung et al.

(10) Patent No.: US 10,187,737 B2
(45) Date of Patent: Jan. 22, 2019

(54) METHOD FOR PROCESSING SOUND ON BASIS OF IMAGE INFORMATION, AND CORRESPONDING DEVICE

(71) Applicant: SAMSUNG ELECTRONICS CO., LTD., Suwon-si (KR)

(72) Inventors: Hyun-joo Chung, Seoul (KR); Sun-min Kim, Yongin-si (KR); Chang-yeong Kim, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/543,791

(22) PCT Filed: Jan. 16, 2015

(86) PCT No.: PCT/KR2015/000495

§ 371 (c)(1),
(2) Date: Jul. 14, 2017

(87) PCT Pub. No.: WO2016/114432

PCT Pub. Date: Jul. 21, 2016

(65) Prior Publication Data

US 2018/0014135 A1 Jan. 11, 2018

(51) Int. Cl.
*H04R 5/00* (2006.01)
*H04S 1/00* (2006.01)
(Continued)

(52) U.S. Cl.
CPC ..... *H04S 1/002* (2013.01); *H04S 1/007* (2013.01); *H04S 3/008* (2013.01); *H04S 5/02* (2013.01);
(Continued)

(58) Field of Classification Search
CPC . H04S 1/00; H04S 1/002; H04S 1/007; H04S 6/305; H04S 7/40; H04S 2400/11;
(Continued)

(56) References Cited

U.S. PATENT DOCUMENTS 7,031,517 B1 * 4/2006 Le ..... G06K 9/342 375/E7.13
8,666,081 B2 3/2014 Oh et al.
(Continued)

FOREIGN PATENT DOCUMENTS

CN 103858447 A 6/2014
EP 2737727 B1 1/2017
(Continued)

OTHER PUBLICATIONS

International Search Report (PCT/ISA/210) dated Oct. 15, 2015, issued by the International Searching Authority in counterpart International Patent Application No. PCT/KR2015/000495.
(Continued)

*Primary Examiner* — Leshui Zhang
(74) *Attorney, Agent, or Firm* — Sughrue Mion, PLLC

(57) ABSTRACT

A method of processing an audio signal including at least one audio object based on image information includes: obtaining the audio signal and a current image that corresponds to the audio signal; dividing the current image into at least one block; obtaining motion information of the at least one block; generating index information including information for giving a three-dimensional (3D) effect in at least one direction to the at least one audio object, based on the motion information of the at least one block; and processing the audio object, in order to give the 3D effect in the at least one direction to the audio object, based on the index information.

15 Claims, 13 Drawing Sheets

(51) Int. Cl.
*H04S 5/02* (2006.01)
*H04S 7/00* (2006.01)
*H04S 3/00* (2006.01)

(52) U.S. Cl.
CPC ..... *H04S 7/305* (2013.01); *H04S 7/40* (2013.01); *H04S 2400/11* (2013.01); *H04S 2400/13* (2013.01); *H04S 2420/01* (2013.01)

(58) Field of Classification Search
CPC ..... H04S 2420/01; H04S 5/00; H04S 5/005; H04S 5/02; G06K 9/00335; G06K 9/00343; G06K 9/00348; G06K 9/00355; G06K 9/00362; G06K 9/00369; G06K 9/00375; G06K 9/00382; G06K 9/00389; G06K 9/00442; G06K 9/00463; G06K 9/00496; G06K 9/00503; G06K 9/0051; G06K 9/00516; G06K 9/00523; G06K 9/0053
USPC .... 381/306, 333, 388, 1, 12, 17, 18, 19, 20, 381/21, 22, 23, 300, 301, 302, 303, 304, 381/305, 307, 309, 310, 311, 80, 81, 82, 381/85, 86, 89, 332, 334, 335, 336, 119, 381/123; 348/E5.125, E5.123, E5.13, 348/423.1, 13.003, 43; 382/173, 180, 382/181, 189, 190, 194, 195, 197, 199, 382/201, 203, 204, 205, 206; 700/94
See application file for complete search history.

(56) References Cited

U.S. PATENT DOCUMENTS

| | | | | |
|---|---|---|---|---|
| 9,154,897 | B2 | 10/2015 | Kraemer et al. | |
| 9,514,768 | B2 | 12/2016 | Jeong et al. | |
| 9,622,007 | B2 | 4/2017 | Cho et al. | |
| 2002/0196362 | A1* | 12/2002 | Yang | H04N 5/145 348/452 |
| 2007/0223874 | A1 | 9/2007 | Hentschel | |
| 2011/0222693 | A1* | 9/2011 | Lee | H03G 9/005 381/17 |
| 2013/0028424 | A1* | 1/2013 | Kim | H04S 1/002 381/17 |
| 2013/0106997 | A1* | 5/2013 | Kim | H04N 13/0203 348/43 |
| 2013/0259236 | A1 | 10/2013 | Chon et al. | |
| 2013/0329922 | A1 | 12/2013 | Lemieux et al. | |
| 2014/0233917 | A1 | 8/2014 | Xiang | |

FOREIGN PATENT DOCUMENTS

| | | | |
|---|---|---|---|
| KR | 2002-0039101 | A | 5/2002 |
| KR | 10-2007-0034462 | A | 3/2007 |
| KR | 10-2010-0066289 | A | 6/2010 |
| KR | 10-2010-0137232 | A | 12/2010 |
| KR | 10-2011-0022886 | A | 3/2011 |
| KR | 10-2011-0105715 | A | 9/2011 |
| KR | 10-2011-0111136 | A | 10/2011 |
| KR | 10-2012-0013894 | A | 2/2012 |
| KR | 10-2013-0045553 | A | 5/2013 |
| KR | 10-2013-0132971 | A | 12/2013 |
| WO | 2011/115430 | A2 | 9/2011 |

OTHER PUBLICATIONS

Written Opinion (PCT/ISA/237) dated Oct. 15, 2015, issued by the International Searching Authority in counterpart International Patent Application No. PCT/KR2015/000495.
Communication dated Jan. 21, 2018 by the Korean Intellectual Property Office in counterpart Korean Patent Application No. 10-2017-7014665.
Communication dated Oct. 9, 2018, issued by the State Intellectual Property Office of People's Republic of China in counterpart Chinese Application No. 201580077494.6.

* cited by examiner

METHOD FOR PROCESSING SOUND ON BASIS OF IMAGE INFORMATION, AND CORRESPONDING DEVICE

TECHNICAL FIELD

One or more exemplary embodiments relate to a method and device for processing sound based on image information.

BACKGROUND ART

As imaging technology has advanced, a television (TV) that supports a three-dimensional (3D) image or an ultra-high definition (UHD) image has been developed and distributed. Stereophonic sound technology for outputting an audio signal that provides an ambience that matches an image has also been developed.

According to a current stereophonic sound technology, a plurality of speakers are located around a user so that the user may feel an ambience and a localization. For example, a stereophonic sound is created by using a 5.1 channel audio system that outputs 6 separated audio signals by using 6 speakers. However, since the stereophonic sound technology does not consider image information, it is difficult to output an audio signal that provides an ambience that matches an image.

Accordingly, there is a demand for a method and apparatus for processing an audio signal according to image information that corresponds to the audio signal.

DETAILED DESCRIPTION OF THE INVENTION

Technical Solution

One or more exemplary embodiments include a method and device for processing an audio signal based on image information.

Advantageous Effects

According to an exemplary embodiment, an audio signal may be processed to be matched with a motion of an image based on informant of a planar image as well as a 3D image.

BEST MODE

Figure 1:
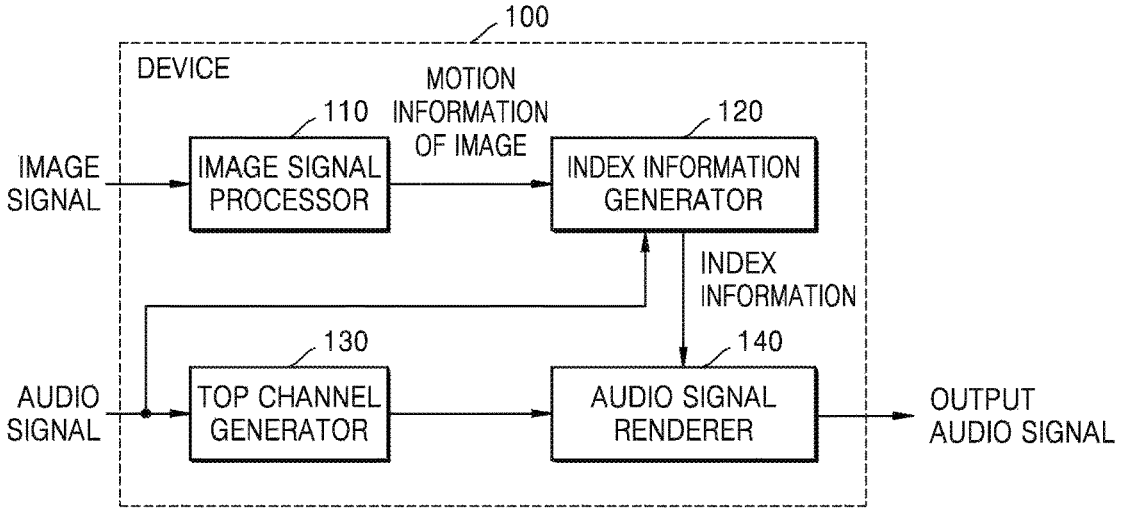
FIG. 1 is a block diagram illustrating an inner structure of a device for processing an audio signal, according to an exemplary embodiment.

According to one or more exemplary embodiments, a method of processing an audio signal including at least one audio object based on image information includes: obtaining the audio signal and a current image that corresponds to the audio signal; dividing the current image into at least one block; obtaining motion information of the at least one block; generating index information including information for giving a three-dimensional (3D) effect in at least one direction to the at least one audio object, based on the motion information of the at least one block; and processing the audio object, in order to give the 3D effect in the at least one direction to the audio object, based on the index information.

The generating of the index information may include obtaining motion information of the current image based on the motion information about the at least one block, and generating the index information based on the motion information of the current image.

The obtaining of the motion information of the at least one block may include: determining a block, having a lowest pixel value difference from each block of the current image, from among at least one block that is included in an image that is prior or subsequent to the current image; and obtaining the motion information of the at least one block of the current image based on the block of the prior or subsequent image corresponding to each block of the current image.

The obtaining of the motion information of the current image may include: when the motion information of the at least one block includes a motion vector value, obtaining at least one representative value according to a distribution of motion vector values of one or more blocks; and obtaining the motion information of the current image including the obtained representative value.

The motion information of the current image may further include a reliability of the motion information of the current image that is determined according to a difference between motion vectors of the one or more blocks, wherein the generating of the index information includes determining the index information by determining a weight based on the reliability and applying the weight to the motion information of the current image.

The index information may be information for giving a 3D effect in at least one of left and right directions, up and down directions, and forward and backward directions to the at least one audio object, and may include a sound panning index in the left and right directions, a depth index in the forward and backward directions, and a height index in the up and down directions.

The generating of the index information may include determining the depth index based on a change in a level of the audio signal.

The generating of the index information may include determining at least one of the depth index and the height index based on characteristics of a distribution of motion vector values of the blocks.

When the current image is a multi-view image including a plurality of images captured at the same time, the index information may be determined based on motion information of at least one of the plurality of images.

The method may further include obtaining disparity information of the current image including at least one of a maximum disparity value, a minimum disparity value, and position information of the current image having a maximum or minimum disparity according to divided regions of the current image, wherein the determining of the index information includes determining a depth index in forward and backward directions based on the disparity information of the current image.

When the audio signal does not include a top channel for outputting an audio signal having a height, the method may further include generating an audio signal of the top channel based on a signal of a horizontal plane channel that is included in the audio signal.

The obtaining of the motion information may include determining a predetermined region of an image corresponding to the at least one audio object and obtaining motion information of a block that is included in the predetermined region of the image.

When the at least one audio object and the current image are not matched with each other and/or when the at least one audio object is a non-effect sound, the index information may be generated to reduce a 3D effect of the at least one audio object.

According to one or more exemplary embodiments, a device for processing an audio signal including at least one audio object includes: a receiver that obtains the audio signal and a current image corresponding to the audio signal; a controller that divides the current image into at least one block, obtains motion information of the at least one block, generates index information including information for giving a 3D effect in at least one direction to the at least one audio object based on the motion information of the at least one block, and processes the at least one audio object in order to give the 3D effect in the at least one direction to the at least one audio object based on the index information; and an audio output unit that outputs the audio signal including the processed at least one audio object.

According to one or more exemplary embodiments, a computer-readable recording medium has embodied thereon a program for executing the method.

According to one or more exemplary embodiments, a computer program is combined with hardware and execute the method.

Mode of the Invention

The inventive concept will be described more fully with reference to the accompanying drawings, in which exemplary embodiments of the inventive concept are shown. While describing the inventive concept, detailed descriptions about related well known functions or configurations that may blur the points of the inventive concept are omitted. In the drawings, like reference numerals denote like elements.

The terms and words which are used in the present specification and the appended claims should not be construed as being confined to common meanings or dictionary meanings but should be construed as meanings and concepts matching the technical spirit of the present invention in order to describe the present invention in the best fashion. Therefore, the exemplary embodiments and structures described in the drawings of the present specification are just exemplary embodiments of the inventive concept, and they do not represent the entire technological concept and scope of the inventive concept. Therefore, it should be understood that there can be many equivalents and modified embodiments that can substitute those described in this specification.

Some elements in the drawings are exaggerated, omitted, or schematically shown. Sizes of elements in the drawings are arbitrarily shown, and thus the exemplary embodiments are not limited to relative sizes or intervals in the drawings.

Unless the context dictates otherwise, the word "comprise" or variations such as "comprises" or "comprising" is understood to mean "includes, but is not limited to" such that other elements that are not explicitly mentioned may also be included. The term "unit" used herein means a software component or a hardware component such as a field-programmable gate array (FPGA) or an application-specific integrated circuit (ASIC), and performs a specific function. However, the term "unit" is not limited to software or hardware. The "unit" may be formed so as to be in an addressable storage medium, or may be formed so as to operate one or more processors. Thus, for example, the term "unit" may refer to components such as software components, object-oriented software components, class components, and task components, and may include processes, functions, attributes, procedures, subroutines, segments of program code, drivers, firmware, micro codes, circuits, data, a database, data structures, tables, arrays, or variables. A function provided by the components and "units" may be associated with the smaller number of components and "units", or may be divided into additional components and "units".

The inventive concept will now be described more fully with reference to the accompanying drawings for those of ordinary skill in the art to be able to perform the inventive concept without any difficulty. The inventive concept may, however, be embodied in many different forms and should not be construed as being limited to the exemplary embodiments set forth herein; rather, these embodiments are provided so that this disclosure will be thorough and complete, and will fully convey the concept of the inventive concept to those of ordinary skill in the art. Also, parts in the drawings unrelated to the detailed description are omitted to ensure clarity of the inventive concept. Like reference numerals in the drawings denote like elements.

An image object refers to a subject such as an object, a person, an animal, or a plant that is included in an image signal.

An audio object refers to each sound component that is included in an audio signal. Various audio objects may be included in one audio signal. For example, a plurality of audio objects that are generated from a plurality of musical instruments such as a guitar, a violin, and an oboe are included in an audio signal that is generated by recording a live performance of an orchestra.

A sound source refers to an object (e.g., a musical instrument or a vocal cord of a person) that generates an audio object. Both an object that actually generates an audio object and an object that is recognized by a user to generate an audio object are regarded as sound sources. For example, when a user watches a movie and an apple flies from an image plane toward the user, a sound that is generated when the apple flies may be included in an audio signal. The sound itself that is generated when the apple flies becomes an audio object. The audio object may be a sound obtained by recording a sound that is generated when the apple actually flies, or may be a sound obtained by simply reproducing an audio object that has been previously recorded. However, in either case, since the user recognizes that the audio object is generated, the apple itself may be also included in a sound source as defined herein.

Three-dimensional (3D) image information includes information that is necessary to three-dimensionally display an image. For example, the 3D image information may include at least one of information indicating a depth of the image and position information indicating a position of an image object on one image plane. The information for indicating the depth of the image refers to information indicating a distance between the image object and a reference position. The reference position may be a surface of a display device through which the image is output. In detail, the information indicating the depth of the image may include a disparity of the image object. The disparity refers to a distance between a left-eye image and a right-eye image that is a binocular parallax.

The inventive concept will now be described more fully with reference to the accompanying drawings, in which exemplary embodiments of the inventive concept are shown.

FIG. 1 is a block diagram illustrating an inner structure of a device 100 for processing an audio signal, according to an exemplary embodiment.

The device 100 according to an exemplary embodiment may obtain motion information of an image from an image signal and may process an audio signal according to the obtained motion information of the image. In detail, the device 100 may process the audio signal so that the audio signal is matched with a motion of the image by using the motion information of the image.

Referring to FIG. 1, the device 100 for processing the audio signal based on image information includes an image signal processor 110, an index information generator 120, a top channel generator 130, and an audio signal renderer 140. In the drawings and exemplary embodiments, elements that are included in the device 100 may be physically or logically separated or integrated.

The image signal processor 110 may obtain the motion information of the image from a current image. In detail, the image signal processor 110 may divide the current image into at least one block and may obtain motion information of each block. The motion information of the block may include a motion vector value indicating a motion direction and a size of the block.

The image signal processor 110 may obtain the motion information of the image from a two-dimensional (2D) image or a 3D image. When the image signal processor 110 obtains the motion information of the image from the 3D image, the image signal processor 110 may obtain the motion information of the image from at least one planar image from among a left image and a right image.

A method of obtaining the motion information of the image from the planar image of the current image will be explained below in detail with reference to FIGS. 3 through 5.

The index information generator 120 generates index information based on the motion information of the image that is obtained by the image signal processor 110. The index information is information for giving a 3D effect in at least one direction to an audio object. For example, the index information may be information for giving a 3D effect in at least one direction from among left and right directions, up and down directions, and forward and backward directions to the audio object. The device 100 may create a 3D effect in up to 6 directions, i.e., the up direction, the down direction, the left direction, the right direction, the forward direction, and the backward direction for each audio object by using the index information. The index information may be generated to correspond to at least one audio object corresponding to the current image.

A method of generating the index information will be explained below in detail with reference to FIGS. 5 through 8.

The top channel generator 130 may change a channel of an input audio signal based on at least one of the number of channels of the input audio signal and an output layout. In detail, when there is no top channel, that is, no channel through which a sound having an elevation is output, in the input audio signal, the top channel generator 130 may generate a top channel from a channel on a horizontal plane.

For example, when the channels of the input audio signal are 2 channels through which a sound is output in left and right directions or 5 channels through which a sound is output in 5 directions such as a central direction, a forward left direction, a forward right direction, a backward left direction, and a backward right direction, the top channel does not exist in the audio signal. The top channel generator 130 may generate the top channel of the audio signal by distributing some of existing channels of the audio signal to the top channel.

When a sound is output through 2 channels, the top channel generator 130 may generate the top channel in a forward direction based on a panning angle value that is obtained according to frequencies of left and right channels. The panning angle refers to an angle in left and right directions indicating a directivity of the audio signal. In detail, the top channel generator 130 may generate the top channel by assigning, to the top channel in the forward direction, a value that is obtained by summing values that are obtained by applying weights to audio signals of the left channel and the right channel according to the panning angle value and a position of the top channel. The present exemplary embodiment is not limited thereto, and the top channel generator 130 may generate the top channel by using any of various methods.

When a sound is output through 5 channels, the top channel generator 130 may generate the top channel in forward left and right directions based on a panning angle value that is obtained according to frequencies of left and right channels in a forward direction. Like in a case where a sound is output through 2 channels, the top channel generator 130 may generate the top channel by assigning, to the top channel in the forward left and right directions, a value obtained by summing values that are obtained by applying weights to audio signals of the left and right channels according to the panning angle value and a position of the top channel. The present exemplary embodiment is not limited thereto, and the top channel generator 130 may generate the top channel by using any of various methods.

In addition, when there is no left and right channels in the input audio signal, the top channel generator 130 may generate the left and right channels from the existing channels of the audio signal according to a layout of a channel through which a sound is be output.

The top channel generator 130 is an element for re-distributing channels so that the audio signal is rendered according to the index information and the layout of the channel through which a sound is to be output. Accordingly, when channel re-distribution is not necessary, the device 100 may not include the top channel generator 130.

The audio signal renderer 140 renders the audio signal based on the index information. In detail, the audio signal renderer 140 may give a 3D effect to each audio object so that the audio object is matched with a motion of the current image according to the index information that is obtained based on the motion information of the image.

The audio signal renderer 140 may process the audio object of the audio signal to be output as if the audio object moves in at least one direction of up and down directions, left and right directions, and forward and backward directions according to each channel according to the index information.

A method of rendering the audio signal according to the index information will be explained below in detail with reference to FIG. 11.

Figure 2:
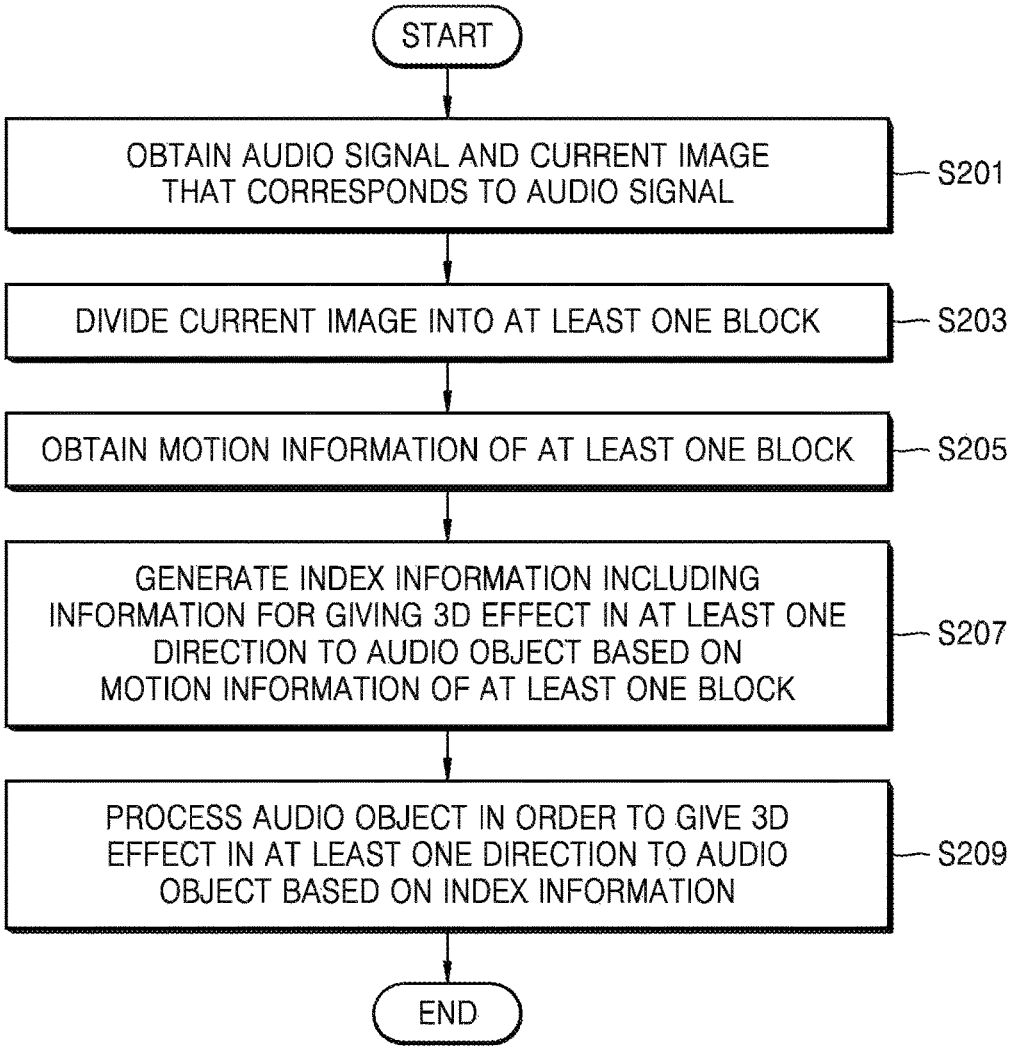
FIG. 2 is a flowchart of a method of processing an audio signal, according to an exemplary embodiment.

FIG. 2 is a flowchart of a method of processing an audio signal, according to an exemplary embodiment.

Referring to FIG. 2, in operation S201, the device 100 may obtain an audio signal and a current image that corresponds to the audio signal. The device 100 may process the audio signal corresponding to each image frame. When an image has a frequency of 24 Hz, the device 100 may distinguish the audio signal at 1/24-second intervals and may process the audio signal based on motion information of the current image corresponding to an audio object of the audio signal.

In operation S203, the device 100 may divide the current image that is obtained in operation S201 into at least one block, and in operation S205, the device 100 may obtain motion information of the at least one block.

In detail, the device 100 may divide an image that is prior or subsequent to the current image into at least one block, and may obtain a block of the prior or subsequent image corresponding to each block of the current image. The device 100 may use a matching sum of absolute differences (SAD) method that may obtain corresponding blocks by comparing differences between pixel values that are included in blocks. By using the matching SAD method, the device 100 may determine a block of another image (e.g., the image that is prior or subsequent to the current image) having a lowest value difference obtained by summing differences between pixel values of a current block as a block that is matched to the current block.

Next, the device 100 may obtain a motion vector of each block of the current image based on a position of the block that is matched to each block of the current image.

In operation S207, the device 100 may generate index information including information for giving a 3D effect in at least one direction to an audio object of the audio signal, based on the motion information of the at least one block that is obtained in operation S205. For example, the index information may include information for giving a 3D effect in at least one direction of left and right directions, up and down directions, and forward and backward directions.

In operation S209, the device 100 may process the audio object in order to give a 3D effect in at least one direction to the audio object based on the index information that is generated in operation S207.

A method of generating index information based on motion information of an image and processing an audio object based on the index information will now be explained in detail.

Figure 3:
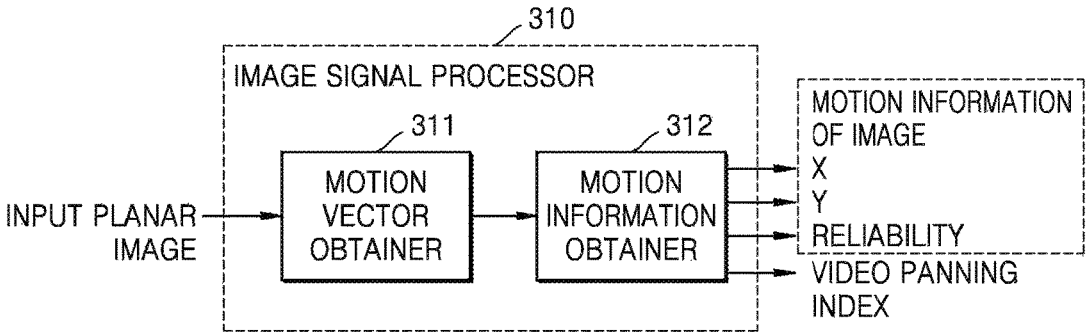
FIG. 3 is a block diagram illustrating an inner structure of an image signal processor that obtains motion information of an image, according to an exemplary embodiment.

FIG. 3 is a block diagram illustrating an inner structure of an image signal processor 310 that obtains motion information of an image, according to an exemplary embodiment. The image signal processor 310 of FIG. 3 corresponds to the image signal processor 110 of FIG. 1.

Referring to FIG. 3, the image signal processor 310 includes a motion vector obtainer 311 and a motion information obtainer 312. In the drawings and exemplary embodiments, elements that are included in the image signal processor 310 may be physically or logically separated or integrated. The image signal processor 310 of FIG. 3 may obtain motion information of an image from a planar image.

When an image is a multi-view image (e.g., a 3D image) containing a plurality of images captured at the same time, the device 100 may obtain the motion information of the image corresponding to an audio signal from at least one image that is selected from the plurality of images captured at the same time. A method of obtaining the motion information of the image including the plurality of images captured at the same time will be explained below in detail with reference to FIG. 9.

The motion vector obtainer 311 may obtain motion vector information of at least one block of an input current image. The motion vector information may include a (x, y) value obtained by using a matching SAD method. In detail, the motion vector obtainer 311 may obtain a block of a prior or subsequent image that is matched to a current block by using the matching SAD method. Next, the motion vector obtainer 311 may obtain a block motion vector (BMV) of the current block by obtaining a motion direction and a size of the current block based on a position of the block that is matched to the current block.

The motion information obtainer 312 may obtain motion information of an image based on the motion vector information of the at least one block that is obtained by the motion vector obtainer 311. The motion information obtainer 312 may obtain motion information of an entire region or a predetermined region of the image from the motion vector information of the block.

For example, the predetermined region of the image may include a region in which an image object corresponding to an audio object is displayed. The device 100 may process the audio object to be matched with a motion of the image based on the motion information of the predetermined region or the entire region of the image.

In addition, the motion information obtainer 312 may divide the image into at least one sub-region and may process the audio signal based on motion information of each sub-region.

According to an exemplary embodiment, when the predetermined region of the image includes the region in which the image object is displayed, the audio object may be processed to be matched with a motion of the image object. Since a motion of the entire region of the image may represent a motion direction of a camera that captures the image, the audio signal may be processed to be matched with the motion direction of the camera according to the motion of the entire region of the image.

The motion information of the image may include a value that is determined based on a distribution of motion vector values of blocks. For example, the motion information of the image may include a global motion vector (GMV) and a reliability of the GMV that are determined according to a distribution of motion vector values of one or more blocks.

The GMV may be determined to be a representative value that represents characteristics of the distribution of the motion vector values of the blocks. For example, the GMV may be determined to be one of a mean value, a median, and a mode (a value that appears most often) of the motion vector values. The GMV may be determined based on motion vectors of blocks that are included in the entire region of the image or the predetermined region of the image corresponding to the audio object.

The reliability of the GMV represents a consistency of a motion of the entire region of the image or the predetermined region of the image object corresponding to the audio object. The reliability may be determined according to a difference between motion vectors of blocks. Accordingly, a reliability value may be determined according to how close the motion vector values of the blocks, which are used to determine the GMV, are to a GMV value. That is, as the motion vector values of the blocks have directions and sizes closer to the GMV value, a higher reliability value may be obtained. In contrast, as a difference between the motion vector values of the blocks increases, the reliability value decreases.

The reliability may have a value ranging from 0 to 1, and the device 100 may determine a weight to be applied to the GMV according to the reliability value. A method of processing the audio signal according to the reliability value will be explained below in detail with reference to FIG. 5.

In addition, the motion information obtainer 312 may obtain a video panning index indicating whether video panning occurs from the image. The video panning refers to a case where an image plane entirely moves in the image. The video panning index may have a value ranging from 0 to 1 according to whether the video panning occurs. The device 100 may determine the weight to be applied to the GMV according to the video panning index. The video panning index may be selectively used in a method of processing an audio signal according to an exemplary embodiment.

Figure 4:
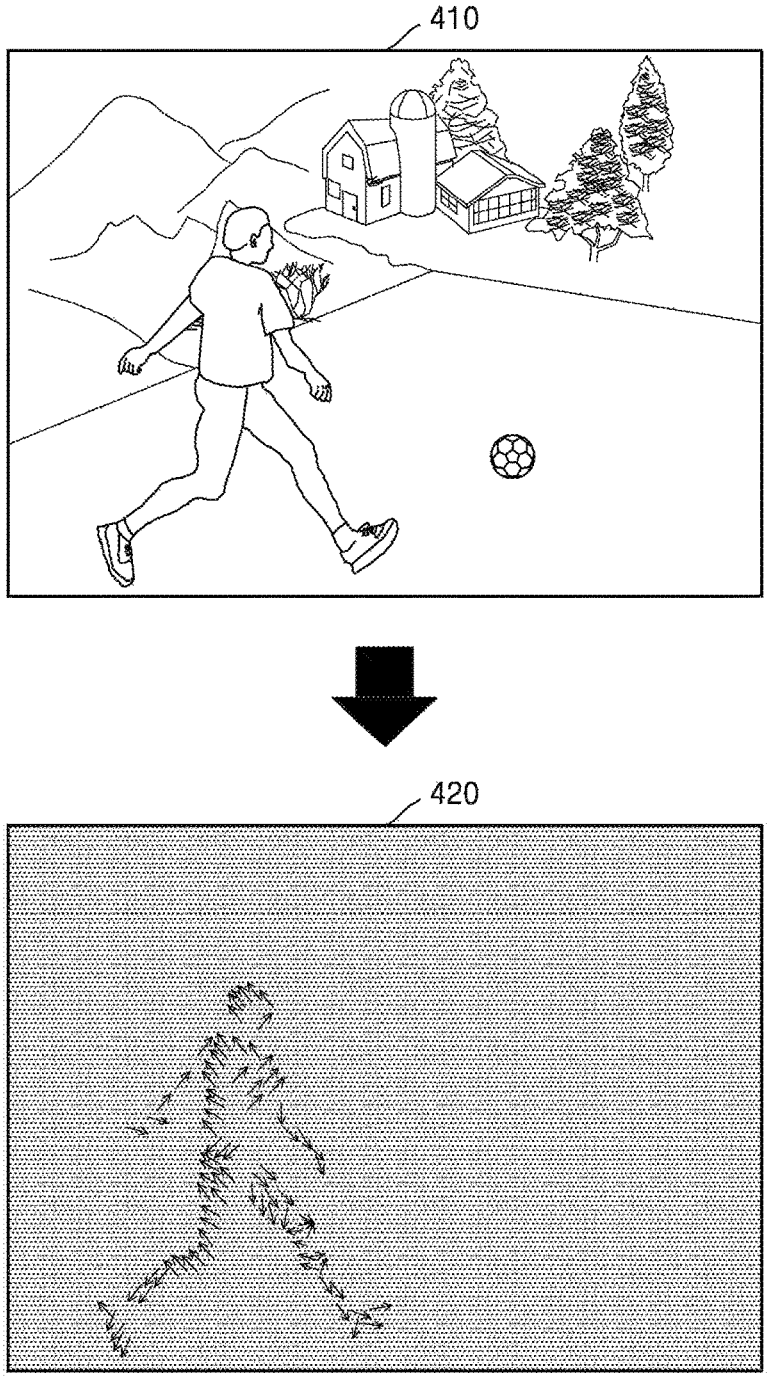
FIG. 4 is a view illustrating a motion vector according to an exemplary embodiment.

FIG. 4 is a view illustrating a motion vector of a block, according to an exemplary embodiment.

Referring to FIG. 4, a motion vector of each block of an image 410 may be obtained as shown in a vector distribution diagram 420. A motion vector value is close to 0 in a background region and is an effective value in a region in which an image object is displayed. The device 100 may determine a region in which the motion vector has an effective value as a region in which the image object corresponding to an audio object is displayed. The device 100 may obtain motion information of an image by obtaining a GMV and a reliability of the region of the image in which the image object is displayed or an entire region of the image.

When the image object corresponding to the audio object is determined to be a soccer ball of the image 410, the device 100 may obtain the motion information of the image including a GMV and a reliability of a region in which the soccer ball is displayed. Next, the device 100 may process the audio object corresponding to the soccer ball according to the motion information of the image.

Figure 5:
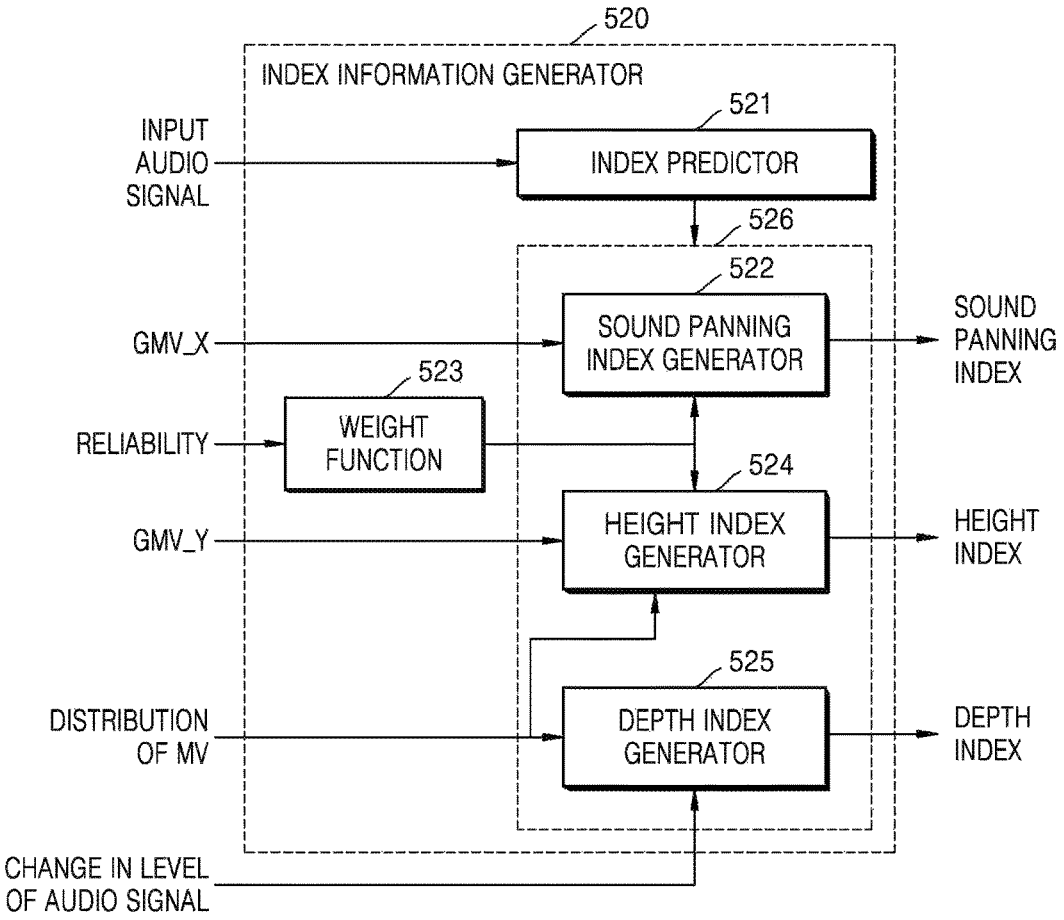
FIG. 5 is a block diagram illustrating an inner structure of an index information generator that determines index information, according to an exemplary embodiment.

FIG. 5 is a block diagram illustrating an inner structure of an index information generator 520 that determines index information, according to an exemplary embodiment. The index information generator 520 of FIG. 5 corresponds to the index information generator 120 of FIG. 1.

Referring to FIG. 5, the index information generator 520 includes an index predictor 521, a sound panning index generator 522, a weight function 523, a height index generator 524, and a depth index generator 525. In the drawings and exemplary embodiments, elements that are included in the index information generator 520 may be physically or logically separated or integrated.

The index information generator 520 of FIG. 5 may generate index information that may be used to render an audio signal from a planar image. The index information generator 520 may generate at least one of a sound panning index, a height index, and a depth index. The elements of the index information generator 520 will now be explained in detail.

When the audio object and an image object are not matched to each other and/or when the audio object is a non-effect sound, the index predictor 521 may determine whether to generate index information to reduce a 3D effect of an audio object When the audio object is not matched with the image object, it may mean that the image object does not generate a sound. If the image object is a vehicle, the image object itself is matched with the audio object that generates a sound. Alternatively, in an image in which a person waves his/her hand, the image object becomes the hand of the person. However, since a sound is not generated when the person waves his/her hand, the image object and the audio object are not matched with each other, and the index predictor 521 may determine whether to generate the index information to minimize a 3D effect of the audio object.

In detail, a depth value in depth information of the index information may be set to a base offset value and sound panning information may be set so that levels of audio signals output from left and right channels are the same. Also, height information may be set to output an audio signal corresponding to a predetermined offset height without considering top and right positions.

Also, when the audio object is a non-effect sound, a sound source may be a static sound source, like in a case where a position of the audio object is barely changed. For example, a voice of a person, a piano accompaniment that is provided at a fixed position or background music is a static sound source, and a position at which a sound is generated is not greatly changed. Accordingly, when the audio object is a non-effect sound, the index information generator 520 may generate the index information to minimize a 3D effect.

The index predictor 521 may track a direction angle of the audio object that is included in a stereo audio signal and may distinguish an effect sound and a non-effect sound based on a result of the tracking. The direction angle may be a global angle, a panning angle, or a forward-backward angle. An angle of a direction in which the non-effect sound is generated may be referred to as the panning angle. Also, an angle at which the non-effect sound is converged may be referred to as the global angle.

At least one of the sound panning index generator 522, the height index generator 524, and the depth index 525 included in 526 may generate an index based on a result of the determination of the index predictor 521. In detail, at least one of the sound panning index generator 522, the height index generator 524, and the depth index 525 that are included in 526 may generate the index information not to give a 3D effect to the audio object or to give a 3D effect according to the base offset value, based on a result of the determination of the index predictor 521.

A method of generating indices of the sound panning index generator 522, the height index generator 524, and the depth index generator 525 that are included in 526 will now be explained in detail.

The index information that may be generated by the index information generator 520 may include at least one of sound panning index information, depth index information, and height index information. The sound panning index information is information for giving a 3D effect to the audio object in left and right directions of an image plane. The depth index information is information for giving a 3D effect to the audio object in forward and backward direction of the image plane. Also, the height index information is information for giving a 3D effect to the audio object in up and down directions of the image plane. The index information generator 520 may generate an index including information for giving a 3D effect to the audio object in other directions than the up and down, forward and backward, and left and right directions.

The sound panning index generator 522 generates the index information that is information for giving a 3D effect in the left and right directions to each audio object. The sound panning index generator 522 may generate sound panning index information that is proportional to a GMV_X value that is a size of a GMV in the left and right directions. The sound panning index information may include a negative value when a motion occurs in the left direction and a positive value when a motion occurs in the right direction.

The sound panning index generator 522 may generate the sound panning index information by using a weight that is determined according to a reliability of the GMV. The weight may be obtained based on the reliability by using the weight function 523. A sigmoid function or a step function using a threshold may be used as the weight function 523.

The height index generator 524 generates the index information that is information for giving a 3D effect in the up and down directions to each audio object. The height index generator 524 may generate height index information that is proportional to a GMV_Y value that is a size of the GMV in the up and down directions. The height index information may include a positive value when a motion occurs in the up direction and a negative value when a movement occurs in the down direction.

The height index generator 524 may generate the sound panning index information by using the weight that is determined according to the reliability of the GMV. The weight may be obtained based on the reliability by the weight function 523. The same weight value that is used by the sound panning index generator 522 may be used by the height index generator 524.

In addition, the height index generator 524 may determine a height index by further considering a distribution of motion vectors. The height index generator 524 may determine an angle of an audio signal from the distribution of the motion vectors and may determine the height index according to the determined angle. The height index generator 524 may generate the height index based on the GMV and the reliability, and then may re-determine the height index according to the distribution of the motion vectors. A method of determining the height index based on the distribution of the motion vectors will be explained below in detail with reference to FIG. 6.

The depth index generator 525 generates the index information that is information for giving a 3D effect in the forward and backward directions to each audio object. The depth index generator 525 may generate the index information based on at least one of the distribution of the motion vectors and a change in a level of the audio signal. The depth index information may include, for example, a positive value when a motion occurs in the forward direction and a negative value when a motion occurs in the backward direction.

When it is determined based on the distribution of the motion vectors that the image object or the image plane moves in the forward and backward directions, the depth index generator 525 may determine the depth index information according to a size of a motion vector. For example, when the motion vectors are distributed to move about one point of an image, the depth index generator 525 may determine that the image includes a motion in the forward and backward directions. A method of determining the depth index information based on the distribution of the motion vectors will be explained below in detail with reference to FIG. 7.

Also, when the audio signal decreases, the depth index generator 525 may determine that a motion occurs in the forward direction, and when the audio signal increases, the depth index generator 525 may determine that a motion occurs in the backward direction. Accordingly, the depth index generator 525 may determine the depth index information according to a change in the level of the audio signal.

Figure 6:
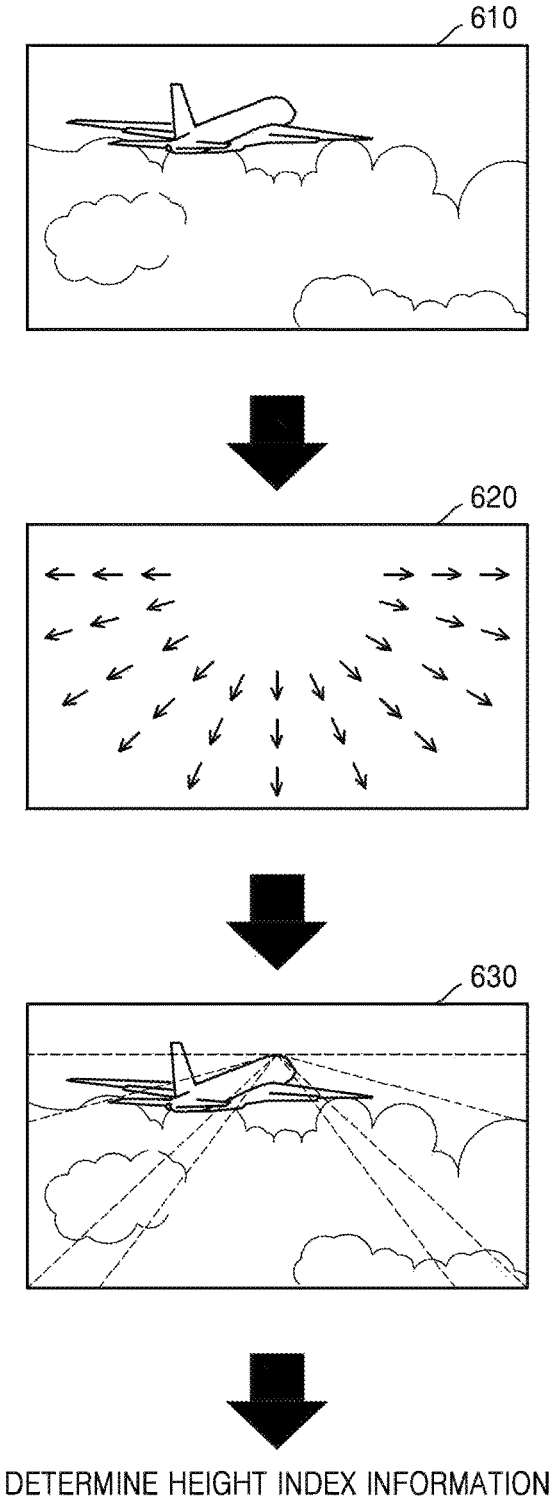
FIG. 6 is a view illustrating an example where height index information is determined based on a distribution of motion vectors, according to an exemplary embodiment.

FIG. 6 is a view illustrating an example where height index information is determined based on a distribution of motion vectors, according to an exemplary embodiment.

Referring to FIG. 6, the height index generator 524 may obtain a distribution diagram 620 of motion vectors from an image 610. The motion vectors may include a GMV or a BMV. Preferably, the motion vectors may include the BMV.

The height index generator 524 may obtain an angle of the motion vectors from the distribution diagram 620 of the motion vectors as shown in 630, and may determine characteristics of a distribution of the motion vectors. The angle of the motion vectors may refer to a central point on which directions of the motion vectors are converged.

As shown in 630, when the motion vectors are distributed in a triangular or trapezoidal shape and the angle of the motion vectors is located at an upper end point of the image, the height index generator 524 may determine that an audio object has a bird's eye view or a height. The height index generator 524 may determine height index information based on sizes and the directions of the motion vectors.

Figure 7:
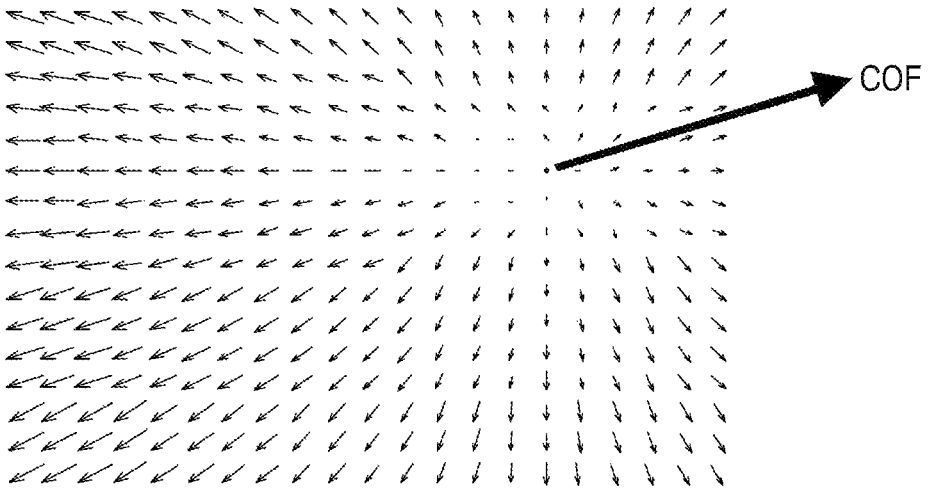
FIG. 7 is a view illustrating a distribution of motion vectors of blocks, according to an exemplary embodiment.

FIG. 7 is a view illustrating a distribution of motion vectors of blocks, according to an exemplary embodiment.

Referring to FIG. 7, directions of the motion vectors are toward a center of focus (COF). When the directions of the motion vectors are toward the COF, the depth index generator 525 may determine that zoom-out occurs, that is, a motion occurs in a forward direction, and may determine depth index information according to sizes of the motion vectors.

In contrast, in a distribution diagram of the motion vectors, when the directions of the motion vectors are away from the COF, the depth index generator 525 may determine that zoom-in occurs, that is, a motion in a backward direction occurs, and may determine depth index information according to sizes of the motion vectors. For example, the depth index generator 525 may obtain sizes of the motion vectors in the forward or backward direction based on the distribution of the motion vectors, and may determine the depth index information based on the sizes of the motion vectors.

Figure 8:
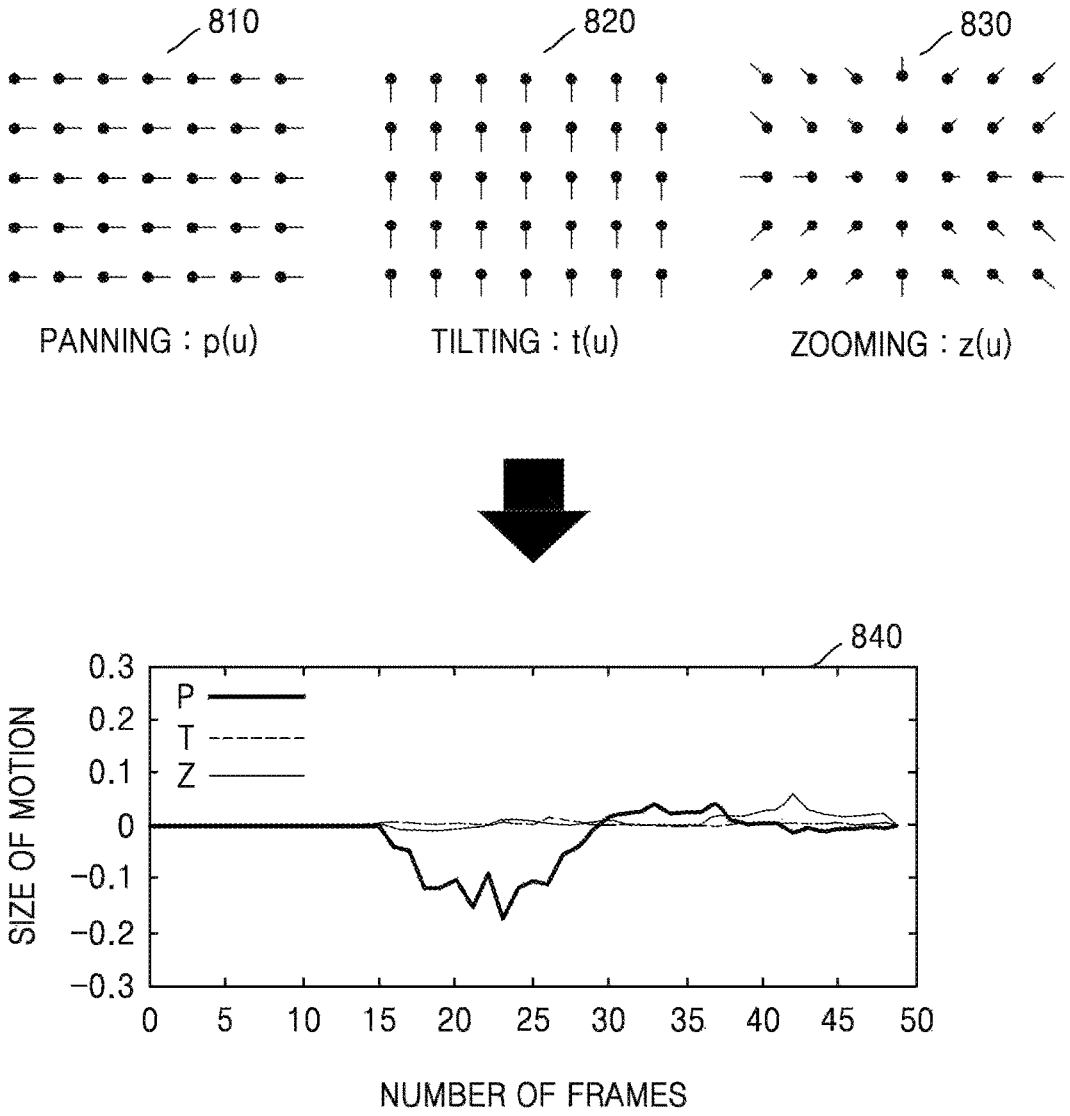
FIG. 8 is a view illustrating motion vectors of blocks, according to an exemplary embodiment.

FIG. 8 is a view illustrating motion vectors of blocks, according to an exemplary embodiment.

Referring to FIG. 8, 810 and 820 show motion vector values in up, down, left, and right directions. 830 shows motion vector values in forward and backward directions.

Motion vector values in the left and right directions, which correspond to panning, may be represented as p(u). Motion vector values in the up and down directions, which correspond to tilting, may be represented as t(u). Motion vector values in the forward and backward directions, which correspond to zooming, may be represented as z(u).

840 is a graph illustrating motion information of an image corresponding to panning P, tilting T, and zooming Z. In the image of the graph 840, a motion seems to often occur in the left and right directions and the forward and backward directions.

Figure 9:
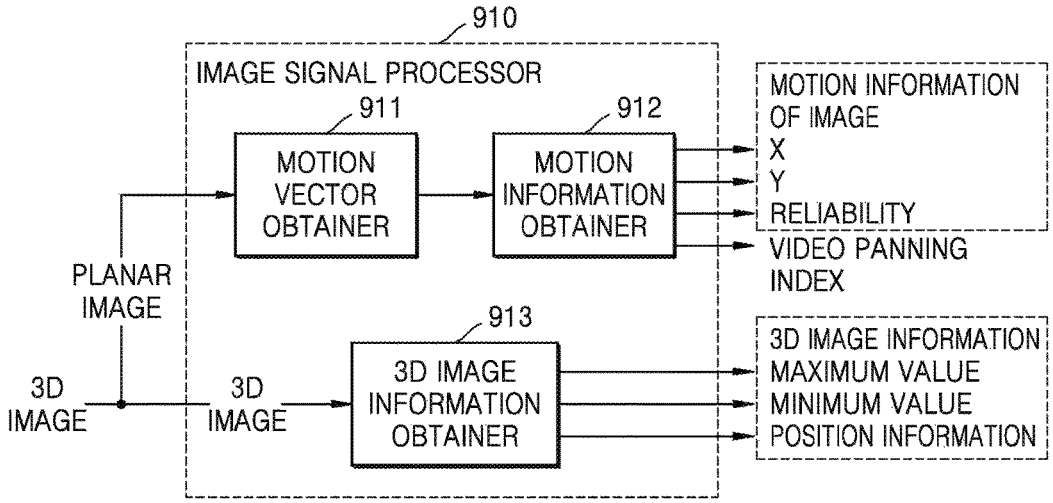
FIG. 9 is a block diagram illustrating an inner structure of an image signal processor that obtains motion information of an image from a three-dimensional (3D) image, according to an exemplary embodiment.

FIG. 9 is a block diagram illustrating an inner structure of an image signal processor 910 that obtains motion information of an image from a 3D image, according to an exemplary embodiment. The image signal processor 910 of FIG. 9 corresponds to the image signal processors 110 and 310 of FIGS. 1 and 3.

Referring to FIG. 9, the image signal processor 910 includes a motion vector obtainer 911, a motion information obtainer 912, and a 3D image information obtainer 913. In the drawings and exemplary embodiments, elements that are included in the image signal processor 910 may be physically or logically separated or integrated. The image signal processor 910 of FIG. 3 may obtain motion information of an image from a planar image.

The image signal processor 910 may include the 3D image information obtainer 913 that obtains 3D image information, unlike the image signal processor 310 of FIG. 3. The 3D image information according to an exemplary embodiment may be used to generate index information along with the motion information of the image.

The motion vector obtainer 911 and the motion information obtainer 912 may obtain a motion vector of a block based on at least one of planar images that are included in a multi-view image, and may obtain the motion information of the image. When the multi-view image is a 3D image, the motion vector obtainer 911 and the motion information obtainer 912 may obtain the motion vector of the block based on one of left and right images, and may obtain the motion information of the image. The motion vector obtainer 911 and the motion information obtainer 912 may obtain the motion vector of the block, like the motion vector obtainer 311 and the motion information obtainer 312 of FIG. 3, and may obtain the motion information of the image.

The 3D image information obtainer 913 may obtain the 3D image information. The 3D image information may include at least one of a maximum disparity value of a current image, a minimum disparity value, and position information of an image object having a maximum or minimum disparity. Also, the 3D image information may include at least one of a disparity value of a main image object in an image frame and position information of the main image object. Alternatively, the 3D image information may include a depth map. Also, when the 3D image information is input according to each frame, the position information of the image object may include information about a sub-frame that is obtained by dividing one image plane corresponding to one frame into at least one. Minimum and maximum disparity information of the image object may be determined according to each sub-frame.

Figure 10:
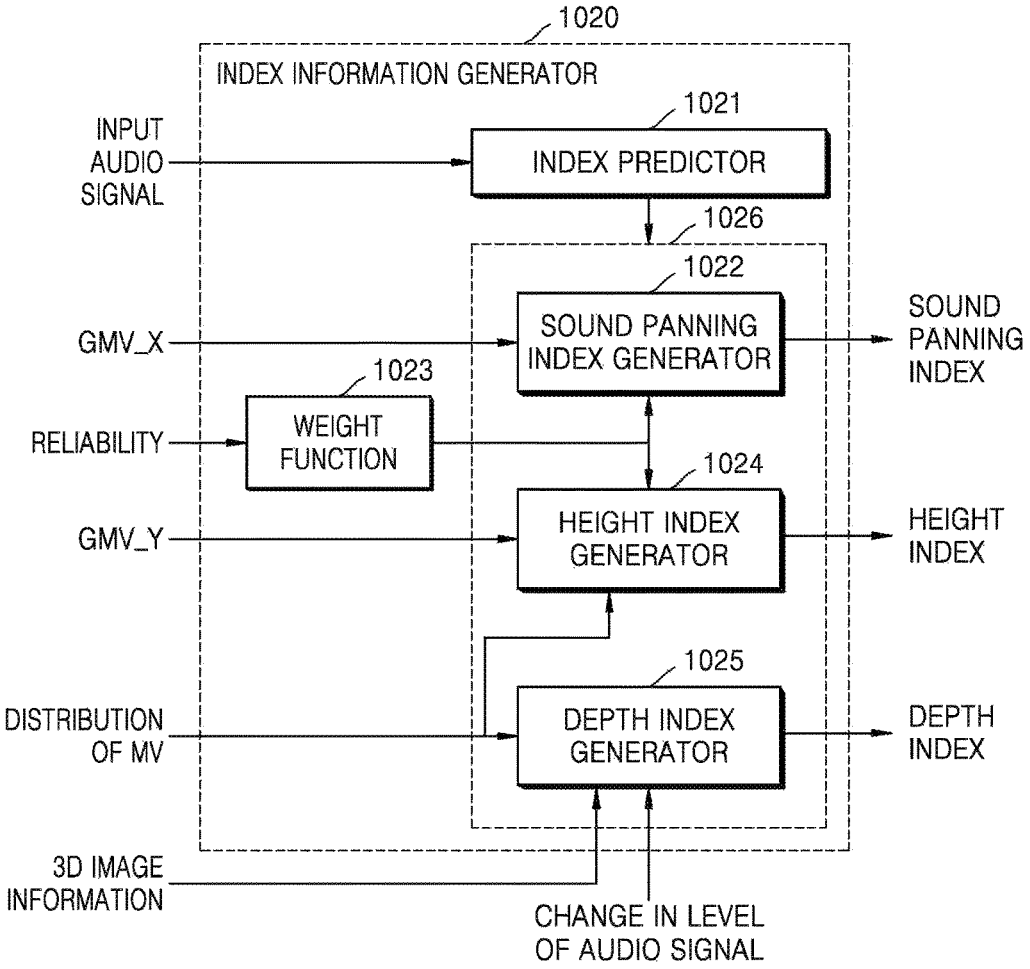
FIG. 10 is a block diagram illustrating an inner structure of an index information generator that generates index information from at least one of 3D image information and motion information of an image, according to an exemplary embodiment.

FIG. 10 is a block diagram illustrating an inner structure of an index information generator 1020 that generates index information from at least one of 3D image information and motion information of an image, according to an exemplary embodiment. The index information generator 1020 of FIG. 10 corresponds to the index information generators 120 and 520 of FIGS. 1 and 5. Also, an index predictor 1021, a sound panning index generator 1022, a weight function 1023, a height index generator 1024, and a depth index generator 1025 of FIG. 10 respectively correspond to the index predictor 521, the sound panning index generator 522, the weight function 523, the height index generator 524, and the depth index generator 525 of FIG. 5.

Referring to FIG. 10, the index information generator 1020 includes the index predictor 1021, the sound panning index generator 1022, the weight function 1013, the height index generator 1024, and the depth index generator 1025. In the drawings and exemplary embodiments, elements that are included in the index information generator 1020 may be physically or logically separated or integrated.

The index information generator 1020 of FIG. 10 may generate index information based on 3D image information and motion information of an image that is obtained from a 3D image. The index information generator 1020 may generate at least one of a sound panning index, a height index, and a depth index. The elements of the index information generator 1020 will now be explained in detail.

When an audio object and an image object are not matched with each other and/or the audio object is a non-effect sound, the index predictor 1021 may determine whether to generate index information to reduce a 3D effect of the audio object.

At least one of the sound panning index generator 1022, the height index generator 1024, and the depth index generator 1025 that are included in 1026 may generate an index based on a result of the determination of the index predictor 1021. In detail, at least one of the index generators 1022, 1024, and 1025 that are included in 1026 generates the index information not to give a 3D effect to the audio object or to give a 3D effect according to a base offset value, based on a result of the determination of the index predictor 1021.

The index information that may be generated by the index information generator 1020 may include at least one of sound panning index information, depth index information, and height index information. A method of generating indices of the sound panning index generator 1022, the height index generator 1024 and the depth index generator 1025 that are included in 1026 will now be explained in detail.

The sound panning index information and the height index information may be generated based on the motion information of the image that is obtained from a planar image. The motion information of the image may include a GMV, a reliability, a motion vector of a block, and a video panning index as described above. The sound panning index generator 1022 and the height index generator 1024 may generate indices in the same manner as that used by the sound panning index generator 522 and the height index generator 524 of FIG. 5.

The depth index generator 1025 may generate a depth index based on at least one of 3D image information, a change in a level of an audio signal, and a motion vector of a block obtained from the planar image. When the 3D image information includes maximum or minimum disparity information, the depth index generator 1025 may estimate depth information in forward and backward directions of the audio object by using the maximum or minimum disparity information. Also, the depth index generator 1025 may generate the depth index based on the estimated depth information.

In addition, the depth index generator 1025 may generate the depth index based on a distribution of motion vectors and the change in the level of the audio signal, like the depth index generator 525 of FIG. 5. In detail, the depth index generator 1025 may determine whether zoom-in or zoom-out occurs based on the distribution of the motion vectors of the blocks that are obtained from the planar image, and may generate the depth index based on a motion vector value.

A method of processing an audio signal based on index information will now be explained in detail with reference to FIG. 11.

Figure 11:
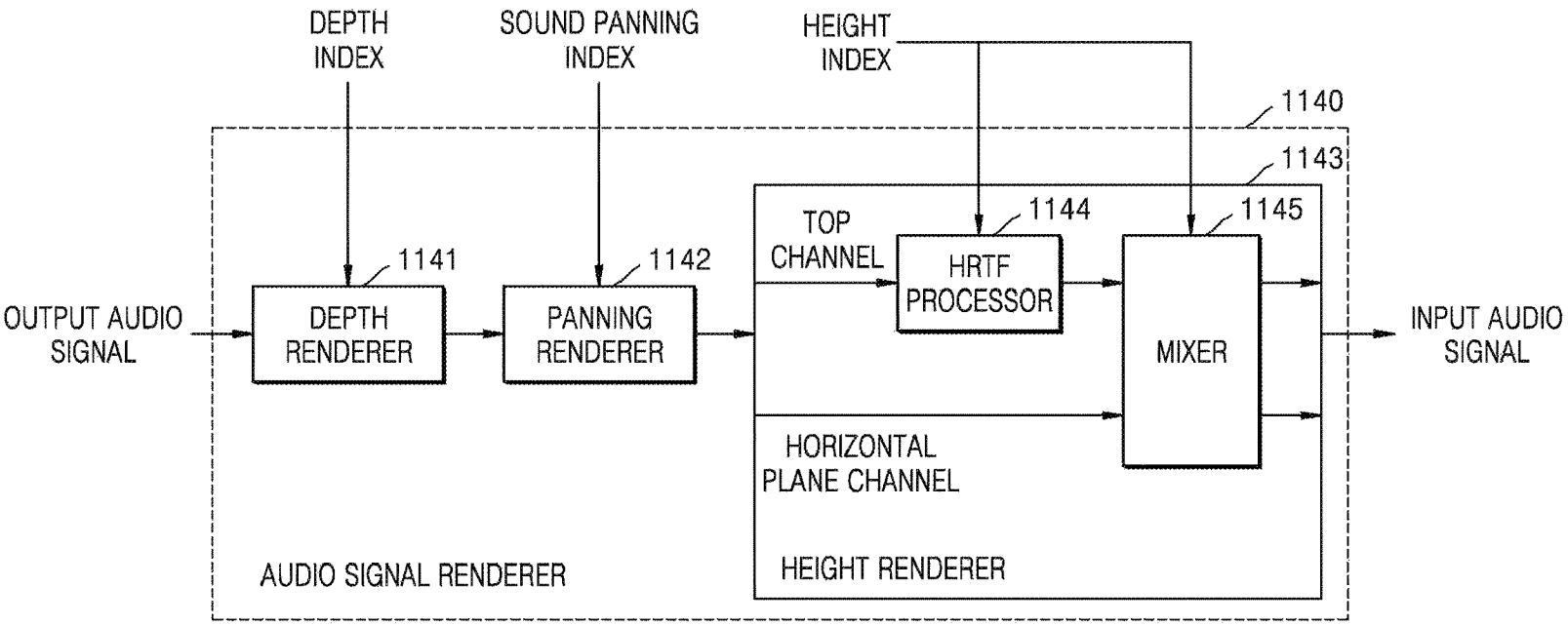
FIG. 11 is a block diagram illustrating an inner structure of an audio signal renderer that processes an audio signal based on index information, according to an exemplary embodiment.

FIG. 11 is a block diagram illustrating an inner structure of an audio signal renderer 1140 that processes an audio signal based on index information, according to an exemplary embodiment. The audio signal renderer 1140 of FIG. 11 corresponds to the audio signal renderer 140 of FIG. 1.

Referring to FIG. 11, the audio signal renderer 1140 includes a depth renderer 1141, a panning renderer 1142, and a height renderer 1143. In the drawings and exemplary embodiments, elements that are included in the audio signal renderer 1140 may be physically or logically separated or integrated.

The audio signal renderer 1140 of FIG. 11 may process an audio signal based on index information that is generated by the index information generator 120, 520, or 1020. The index information that may be used to process the audio signal may include at least one of a sound panning index, a height index, and a depth index. The elements of the audio signal renderer 1140 will now be explained in detail.

The depth renderer 1141 may give a 3D effect in forward and backward directions to an audio object based on the depth index. In detail, the depth renderer 1141 may operate so that the audio object is localized to be matched with a motion of an image in the forward and backward directions according to the depth index.

The panning renderer 1142 may give a 3D effect in left and right directions to the audio object based on the sound panning index. In detail, the panning renderer 1142 may operate so that the audio object is localized to be matched with the motion of the image in the left and right directions according to the sound panning index.

The height renderer 1143 may give a 3D effect in up and down directions to the audio object based on the height index. The height renderer 1143 may include a head-related transfer filter (HRTF) processor 1144 and a mixer 1145, and may distinguish and process audio signals of a top channel and a horizontal plane channel.

The HRTF processor 1144 passes an audio signal through an HRTF filter that corresponds to a height angle according to the height index. As a height index value increases, an audio signal corresponding to a higher height angle may be output. The HRTF filter may enable a stereophonic sound to be perceived by using a phenomenon where a simple difference of paths, such as an inter-aural time difference (ITD) that is a difference in an arrival time of a sound between two ears and an inter-aural level difference (ILD) that is a difference in a level of a sound between two ears and complex characteristics on the paths, such as diffraction from a surface of the head or reflection from an earflap, vary according to a direction in which a sound arrives. The HRTF processor 1144 may model a sound that is generated from a higher height than speakers by using the speakers that are disposed on a horizontal plane through the HRTF filter.

The mixer 1145 may mix and output audio signals of channels according to an output speaker. A method of mixing the audio signals according to the output speaker will now be explained.

When the output speaker is a stereo speaker that is mounted on a general digital TV, the mixer 1145 may apply a high weight to an audio signal of a top channel that is HRTF processed according to a height index, and may output a resultant signal. That is, the mixer 1145 may operate so that the audio signal of the top channel that is HRTF processed is more strongly output than when an upper speaker that may output the top channel exists.

When the output speaker is a 4-channel output speaker including the upper speaker or a speaker that may output the top channel exists, HRTF processing may not be performed by the HRTF processor 1144. However, the mixer 1145 may give a height to an audio signal according to motion information of an image by controlling a gain of the audio signal that is output from each speaker according to a height index. In addition, in order to give an additional height to an audio signal that is output from the upper speaker, the mixer 1145 may output an audio signal that is HRTF processed.

In a 4-channel output digital TV, speakers may be located around four edges of the TV, bottom left and right speakers may form a sound image of a bottom layer and top left and right speakers may form a sound image of a top layer. The mixer 1145 may control a gain applied to an audio signal that is output to the bottom layer and an audio signal that is output to the top layer according to a height index in order to localize the sound images of the top layer and the bottom layer.

Figure 12:
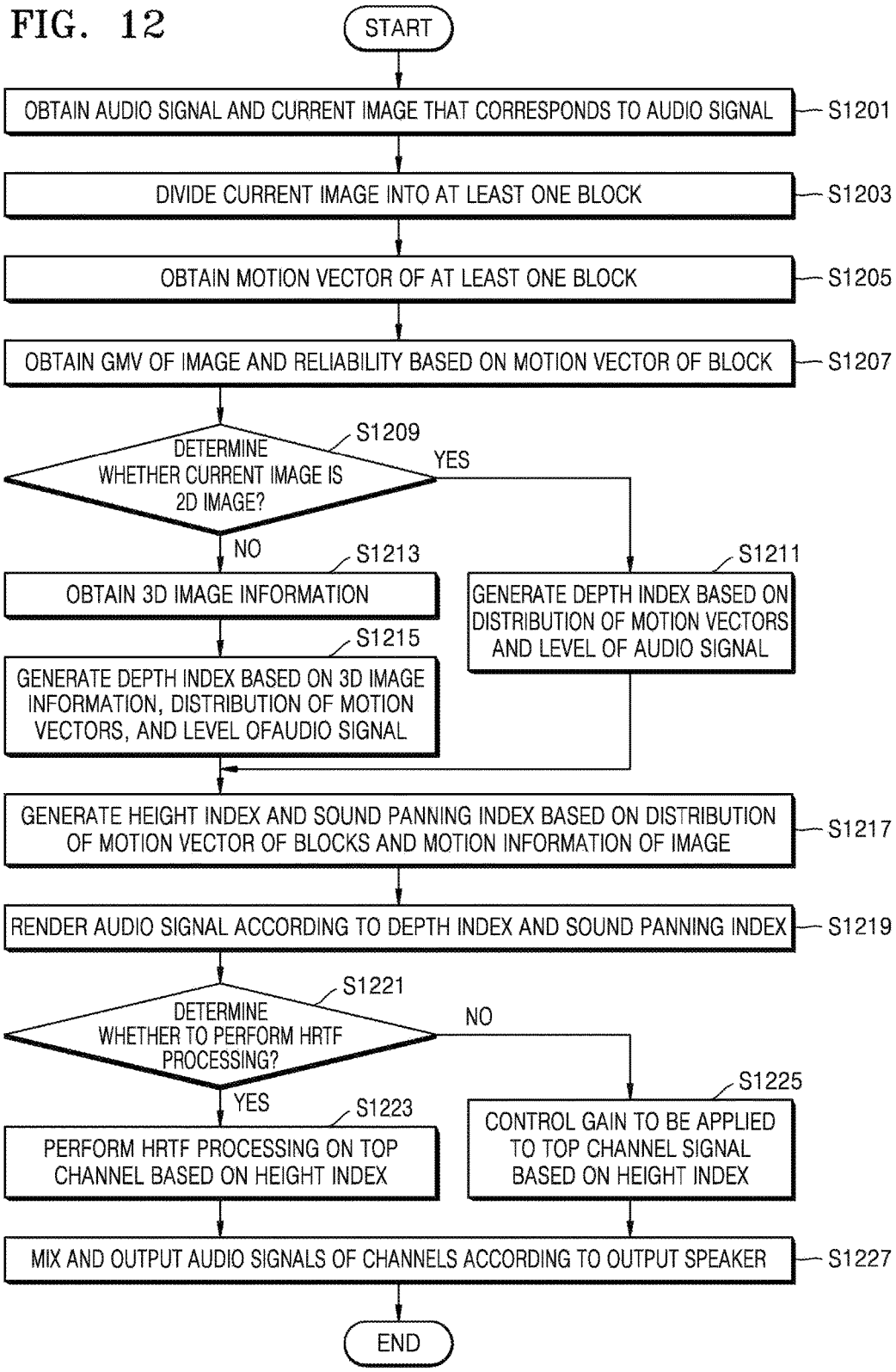
FIG. 12 is a flowchart of a method of processing an audio signal based on image information, according to an exemplary embodiment.

FIG. 12 is a flowchart of a method of processing an audio signal based on image information, according to an exemplary embodiment.

Referring to FIG. 12, in operation S1201, the device 100 may obtain an audio signal and a current image that corresponds to the audio signal.

In operation S1203, the device 100 may divide the current image into at least one block. In operation S1205, the device 100 may obtain a motion vector of the at least one block obtained in operation S1203. The device 100 may obtain the motion vector of the block by using a matching SAD method.

When the current image is a 3D image, the device 100 may divide at least one planar image from among left and right images into at least one block and may obtain a motion vector of each block. Even when the current image is a multi-view image instead of a 3D image, the device 100 may divide at least one planar image from among a plurality of images captured at the same time into at least one block and may obtain a motion vector of each block.

In operation S1207, the device 100 may obtain a motion vector and a reliability of an image based on the motion vector of the block. In detail, the device 100 may obtain a GMV of the image and a reliability of the GMV according to a distribution of motion vector values of the one or more blocks. The device 100 may obtain the GMV and the reliability based on a motion vector value of a block that is included in a predetermined region or an entire region of the image.

In operation S1209, it is determined whether the current image is a 2D image, that is, a planar image. When the current image is a 2D image, the device 100 may not obtain disparity information indicating a 3D effect of the image for determining a depth index from the current image. Accordingly, when it is determined in operation S1209 that the current image is a 2D image, the method proceeds to operation S1211. In operation S1211, the device 100 may determine the depth index based on at least one of a distribution of motion vectors and a level of the audio signal, instead of the disparity information.

In detail, when the distribution of the motion vectors corresponds to zoom-in or zoom-out away from or toward a COF, it may be determined that a motion of the image occurs in forward and backward directions. Accordingly, the device 100 may generate the depth index based on sizes of the motion vectors corresponding to the zoom-in or zoom-out. In addition, the device 100 may generate the depth index by further considering a change in the level of the audio signal.

In contrast, when the current image is a 3D image, the device 100 may obtain the disparity information indicating the 3D effect of the image for determining the depth index from the current image.

When it is determined in operation S1209 that the current image is a 3D image, the method proceeds to operation S1213. In operation S1213, the device 100 obtains 3D image information including the disparity information from the current image. In operation S1215, the device 100 may generate the depth index based on the 3D image information that is obtained in operation S1213.

In addition, like in operation S1211, the device 100 may determine the depth index based on at least one of the distribution of the motion vectors and the level of the audio signal. In operation S1205, the distribution of the motion vectors may be obtained from at least one of planar images that constitute the 3D image or the multi-view image.

In operation S1217, the device 100 may generate a height index and a sound panning index based on at least one of the distribution of the motion vectors of the blocks and motion information of the image that are obtained in operations S1205 through S1207. The motion information of the image may include the GMV and the reliability of the GMV.

In operation S1219, the device 100 may render the audio signal according to the depth index and the sound panning index that are obtained in operations S1215 or S1211, and S1217. In detail, the device 100 may give a 3D effect in left and right directions and forward and backward directions to the audio signal so that the audios signal is matched with the motion of the image according to the depth index and the sound panning index.

In operation S1221, the device 100 may determine whether to perform HRTF processing in order to give a 3D effect to the audio signal in up and down directions. The device 100 may determine whether to perform HRTF processing according to whether an upper speaker for outputting an audio signal of a top channel is included in an output speaker. In addition, the device 100 may determine whether to perform HRTF processing by further considering whether an additional height needs to be applied to the audio signal that is output from the upper speaker.

When it is determined in operation S1221 that HRTF is to be performed, the method proceeds to operation S1223. In operation S1223, the device 100 may perform HRTF processing on the audio signal of the top channel based on the height index in order to apply a height to the audio signal.

When it is determined in operation S1221 that HRTF processing is not to be performed, the method proceeds to operation S1225. In operation S1225, the device 100 may apply a height to the audio signal by adjusting a gain of the audio signal of the top channel based on the height index.

When the upper speaker for outputting the audio signal of the top channel is included in the output speaker, the device 100 may apply a height to the audio signal by adjusting a gain of the audio signal of the top channel to be proportional to the height index.

In operation S1223, the device 100 may perform HRTF processing on the audio signal in order to apply an additional height to the audio signal that is output from the upper speaker.

In operation S1227, the device 100 may mix and output audio signals of channels according to the output speaker.

Elements of devices 1300 and 1400 will now be explained in detail with reference to FIGS. 13 and 14.

Figure 13:
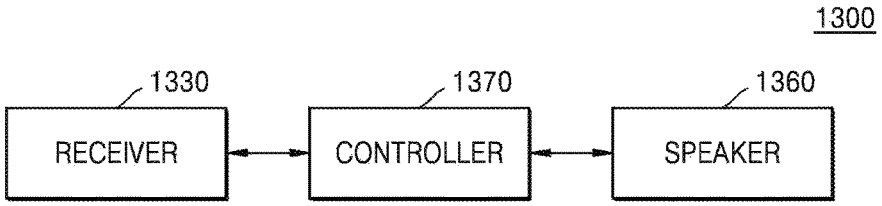
FIGS. 13 and 14 are block diagrams illustrating inner structures of devices that process an audio signal based on image information, according to exemplary embodiments.
Figure 14:
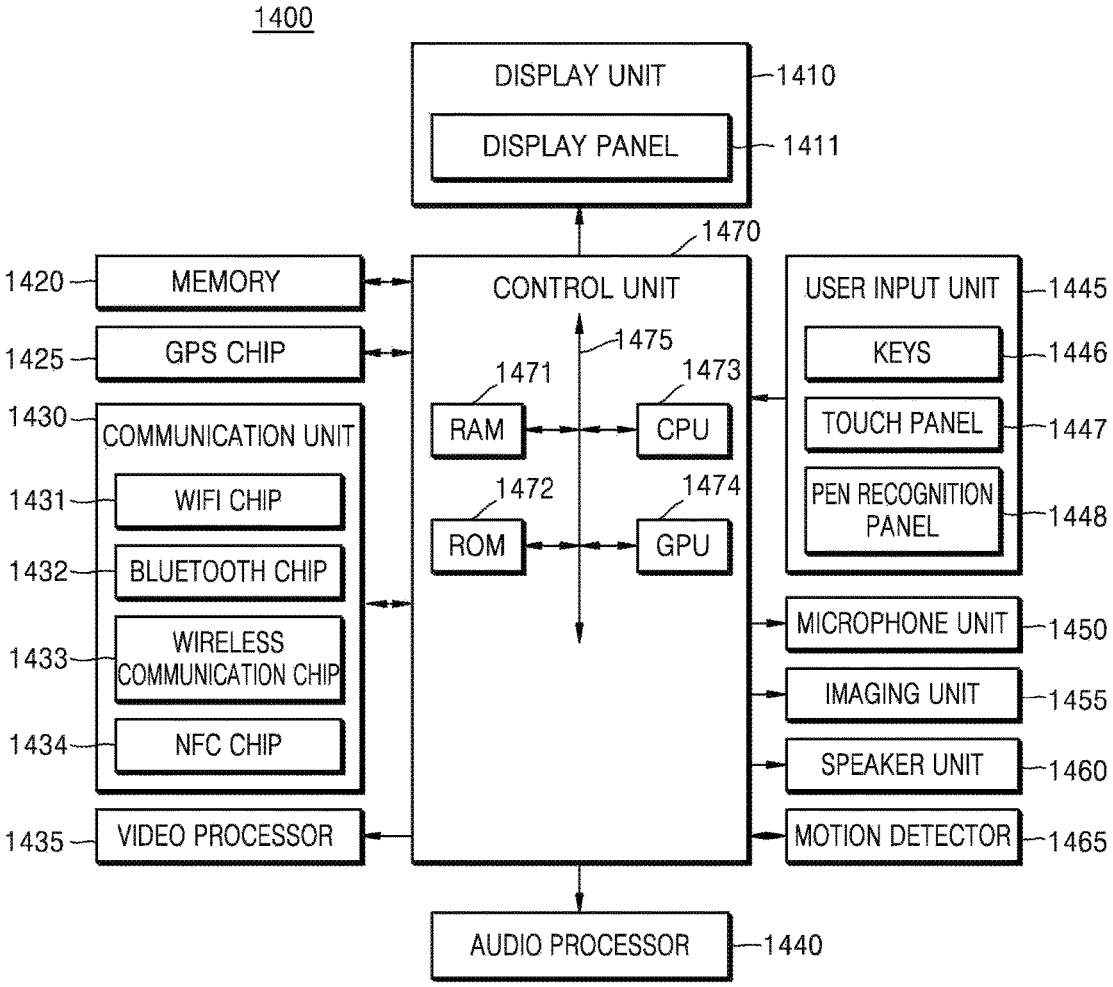

FIGS. 13 and 14 are block diagrams illustrating inner structures of the devices 1300 and 1400 that process an audio signal based on image information, according to exemplary embodiments. The devices 1300 and 1400 of FIGS. 13 and 14 may correspond to the device 100 of FIG. 1.

The devices 1300 and 1400 of FIGS. 13 and 14 may be applied to various devices such as a mobile phone, a tablet PC, a personal digital assistant (PDA) an MP3 player, a kiosk, an electronic frame, a navigation system, a digital TV, a wrist watch, and a wearable device such as a head-mounted display (HMD).

Referring to FIG. 13, the device 1300 may include a receiver 1330, a controller 1370, and a speaker 1360. In the drawings and exemplary embodiments, elements that are included in the device 1300 may be physically or logically separated or integrated.

The receiver 1330 may obtain an audio signal and a current image that corresponds to the audio signal.

The controller 1370 may divide the current image that is obtained by the receiver 1330 into at least one block, and may generate index information based on motion information of the at least one block. Also, the controller 1370 may process an audio object in order to give a 3D effect in at least one of left and right, up and down, and forward and backward directions to the audio object that is included in the audio signal, based on the index information.

The speaker 1360 may output the audio signal including the audio object that is processed in order to give the 3D effect by the controller 1370.

However, all of the elements of FIG. 13 are not essential. More elements may be included in the device 1300 or fewer elements may be included in the device 1300.

For example, as shown in FIG. 14, the device 1400 according to an exemplary embodiment may further include a memory 1420, a global positioning system (GPS) chip 1425, a communication unit 1430, a video processor 1435, an audio processor 1440, a user input unit 1445, a microphone unit 1450, an imaging unit 1455, and a motion detector 1465, instead of the receiver 1330, the controller 1370, and the speaker 1360. The receiver 1330 may correspond to the communication unit 1430 and the speaker 1360 may correspond to the speaker unit 1460.

The elements will now be sequentially explained.

The display unit 1410 may include a display panel 1411 and a controller (not shown) that controls the display panel 1411. Examples of the display panel 1411 may include a liquid-crystal display (LCD), an organic light-emitting diode (OLED), an active-matrix OLED (AM-OLED), and a plasma display panel (PDP). The display panel 1411 may be flexible, transparent, or wearable. The display unit 1410 may be coupled to a touch panel 1447 of the user input unit 1445 and may be provided as a touchscreen. For example, the touchscreen may include an integrated module in which the display panel 1411 and the touch panel 1447 are stacked on each other.

The display unit 1410 according to an exemplary embodiment may display an image corresponding to an audio signal that is output through the speaker unit 1460 under the control of a control unit 1470. Examples of the image that may be displayed by the display unit 1410 may include a planar image and a 3D image.

The memory 1420 may include at least one of an internal memory (not shown) and an external memory (not shown).

The internal memory may include at least one of, for example, a volatile memory (e.g., a dynamic random-access memory (DRAM), a static RAM (SRAM), or a synchronous dynamic RAM (SDRAM), a nonvolatile memory (e.g., a one-time programmable ROM (OTPROM), a programmable ROM (PROM), an erasable and programmable ROM (EPROM), an electrically erasable and programmable ROM (EEPROM), a mask ROM, or a flash ROM), a hard disk drive (HDD), and a solid-state drive (SSD). According to an exemplary embodiment, the control unit 1470 may load a command or data that is received from at least one of the nonvolatile memory or other elements to the volatile memory and then may process the command or data. Also, the control unit 1470 may store data that is received or generated from other elements in the nonvolatile memory.

The external memory may include at least one of, for example, a compact flash (CF), a secure digital (SD), a micro-secure digital (micro-SD), a mini-secure digital (mini-SD), an extreme digital (xD), and a memory stick.

The memory 1420 may store various programs and data that are used to operate the device 1400. According to an exemplary embodiment, at least one of an image, an audio signal corresponding to the image, and 3D image information may be temporarily or permanently stored in the memory 1420.

The control unit 1470 may control the display unit 1410 to display on the display unit 1410 part of information that is stored in the memory 1420. In other words, the control unit 1470 may display on the display unit 1410 an image that is stored in the memory 1420. Alternatively, when a user's gesture occurs in a region of the display unit 1410, the control unit 1470 may perform a control operation corresponding to the user's gesture.

The control unit 1470 may include at least one of a RAM 1471, a read-only memory (ROM) 1472, a central processing unit (CPU) 1473, a graphics processing unit (GPU) 1474, and a bus 1475. The RAM 1471, the ROM 1472, the CPU 1473, and the GPU 1474 may be connected to one another via the bus 1475.

The CPU 1473 accesses the memory 1420 and performs booting by using an O/S that is stored in the memory 1420. The CPU 1473 performs various operations by using various programs, content, and data that are stored in the memory 1420.

A command set for booting a system is stored in the ROM 1472. For example, when a turn-on command is input and power is supplied to the device 1400, the CPU 1473 may boot the system by copying the O/S that is stored in the memory 1420 to the RAM 1471 according to a command that is stored in the ROM 1472 and executing the O/S. When the booting is completed, the CPU 1473 performs various operations by copying the various programs that are stored in the memory 1420 to the RAM 1471 and executing the copied various programs.

When the booting of the device 1400 is completed, the GPU 1474 displays a user interface (UI) screen on a region of the display unit 1410. In detail, the GPU 1474 may generate the UI screen including various objects such as content, icons, and menus. The UI screen according to an exemplary embodiment may be used to output an image and an audio signal. The GPU 1474 calculates an attribute value such as a coordinate value, a shape, a size, or a color of each object according to a layout of the UI screen. The GPU 1474 may generate the UI screen having various layouts including the object based on the calculated attribute value. The UI screen that is generated by the GPU 1474 may be provided to the display unit 1410 and may be displayed in each region of the display unit 1410.

The GPS chip 1425 may receive a GPS signal from a GPS satellite, and may calculate a current position of the device 1400. When a navigation program is used or a current position of a user is necessary, the control unit 1470 may calculate a position of the user by using the GPS chip 1425.

The communication unit 1430 may communicate with various external devices according to various communication methods. The communication unit 1430 may include at least one of a WiFi chip 1431, a Bluetooth chip 1432, a wireless communication chip 1433, and a near-field communication (NFC) chip 1434. The control unit 1470 may communicate with various external devices by using the communication unit 1430. For example, the control unit 1470 may receive an image and an audio signal that are to be displayed on the display unit 1410 by using the communication unit 1430.

The WiFi chip 1431 and the Bluetooth chip 1432 may respectively perform communication by using a WiFi method and a Bluetooth method. When the WiFi chip 1431 or the Bluetooth chip 1432 is used, various pieces of connection information such as a service set identifier (SSID) and a session key may be first transmitted/received, and then various pieces of information may be transmitted/received by using the various pieces of connection information. The wireless communication chip 1433 refers to a chip that performs communication according to various communication standards such as Institute of Electrical and Electronics Engineers (IEEE), ZigBee, $3^{rd}$ Generation (3G), $3^{rd}$ Generation Partnership Project (3GPP), and Long-Term Evolution (LTE). The NFC chip 1434 refers to a chip that operates by using an NFC method that uses a frequency band of 13.56 MHz from among various radio frequency identification (RF-ID) frequency bands such as 135 kHz, 13.56 MHz, 433 MHz, 860-960 MHz, and 2.45 GHz.

The video processor 1435 may process image data that is received through the communication unit 1430 or image data that is stored in the memory 1430. The video processor 1435 may perform various image processing such as decoding, scaling, noise filtering, frame rate conversion, or resolution change on the image data. The display unit 1410 may display the image data that is processed by the video processor 1435.

The audio processor 1440 may process audio data that is received through the communication unit 14360 or audio data that is stored in the memory 1420. The audio processor 1440 may perform various processing such as decoding, amplification, and noise filtering on the audio data. For example, the audio processor 1440 may process audio data that corresponds to an image displayed on the display unit 1410. In addition, the audio processor 1440 may output audio data by performing processing for giving a 3D effect to an audio signal based on image information according to an exemplary embodiment.

When a program for reproducing multimedia content is executed, the control unit 1470 may drive the video processor 1435 and the audio processor 1440 to reproduce the multimedia content. The speaker unit 1460 may output audio data that is generated by the audio processor 1440. For example, the control unit 1470 may process multimedia content that is displayed on the display unit 1410 by using the video processor 1435 and the audio processor 1440.

The user input unit 1445 may receive various commands from the user. The user input unit 1445 may include at least one of keys 1446, a touch panel 1447, and a pen recognition panel 1448. The device 1400 may output an image and an audio signal according to a user input that is received from at least one of the keys 1446, the touch panel 1447, and the pen recognition panel 1448.

The keys 1446 may include various keys such as mechanical buttons and a wheel that are formed on various portions such as a front portion, a side portion, and a rear portion of an outer surface of a main body.

The touch panel 1447 may detect the user's touch input and may output a touch event value corresponding to a detected touch signal. When the touch panel 1447 is coupled to the display panel 1411 and is provided as a touchscreen (not shown), the touchscreen may include any of various touch sensors using a capacitive method, a resistive method, and a piezoelectric method. In the capacitive method, a dielectric substance is coated on a surface of the touchscreen, and when a body part of the user touches a surface of the touchscreen, fine electricity that is produced by the body part of the user is detected and touch coordinates are calculated. In the resistive method, assuming that two electrode plates that are vertically arranged are embedded in the touchscreen, and when the user touches the touchscreen, the two plates contact each other at a touched point, the flow of current is detected, and touch coordinates are calculated. A touch event that occurs on the touchscreen may be usually generated by a person's finger, but the present exemplary embodiment is not limited thereto and such a touch event may be generated by a conductive material that may change a capacitance.

The pen recognition panel 1448 may detect a proximity input or a touch input with the user's pen for touch such as a stylus pen or a digitizer pen and may output a pen proximity event or a pen touch event. The pen recognition panel 1448 may use an electromagnetic resonance (EMR) method, and may detect the touch input or the proximity input by using a change in an intensity of an electromagnetic field when the pen is closer or touches. In detail, the pen recognition panel 1448 may include an electromagnetic induction coil sensor (not shown) that has a grid structure and an electromagnetic signal processor (not shown) that sequentially applies alternating current (AC) signals having predetermined frequencies to loop coils of the electromagnetic induction coil sensor. When a pen in which a resonance circuit is provided is located around a loop coil of the pen recognition panel 1448, a magnetic field that is transmitted from the loop coil generates current based on mutual electromagnetic induction in the resonance circuit provided in the pen. Based on the current, an induced magnetic field may be generated from a coil of the resonance circuit provided in the pen, and the pen recognition panel 1448 may detect the induced magnetic field from the loop coil that is in a signal receiving state and thus may detect a proximity position or a touch position of the pen. The pen recognition panel 1448 may be provided under the display panel 1411 to have an area large enough to cover, for example, a display region of the display panel 1411.

The microphone unit 1450 may receive the user's voice or other sounds and may change the user's voice or other sounds into audio data. The control unit 1470 may use the user's voice that is input through the microphone unit 1450 in a call operation, or may change the user's voice into audio data and may store the audio data in the memory 1420.

The imaging unit 1455 may obtain a still image or a moving image according to the user's control. A plurality of the imaging units 1455 may be provided as, for example, a front camera and a rear camera.

When the imaging unit 1455 and the microphone unit 1450 are provided, the control unit 1470 may perform a control operation according to the user's motion that is recognized by the imaging unit 1455 or the user's voice that is input through the microphone unit 1450. For example, the device 1400 may operate in a motion control mode or a voice control mode. When the device 1400 operates in the motion control mode, the control unit 1470 may activate the imaging unit 1455 to photograph the user, may track a change in the user's motion, and may perform an appropriate control operation. For example, the control unit 1470 may output an image and an audio signal according to the user's motion input that is detected by the imaging unit 1455. When the device 1400 operates in the voice control mode, the control unit 1470 may analyze the user's voice that is input through the microphone unit 1450 and may perform a control operation in the voice recognition mode according to the analyzed user's voice.

The motion detector 1465 may detect a motion of the main body of the device 1400. The device 1400 may rotate or tilt in various directions. In this case, the motion detector 1465 may detect motion characteristics such as a rotation direction, a rotation angle, and a gradient, by using at least one of various sensors such as a geo-magnetic sensor, a gyro sensor, and an acceleration sensor. For example, the motion detector 1465 may detect the user's input by detecting the motion of the main body of the device 1400 and may output an image and an audio signal according to the received user's input.

In addition, although not shown in FIGS. 13 and 14, according to exemplary embodiments, the device 1400 may further include a universal serial bus (USB) port to which a USB connector may be connected, various external input ports that are connected to various external terminals such as a headset, a mouse, and a local area network (LAN), a digital multimedia broadcasting (DMB) chip that receives and processes a DMB signal, and various sensors.

Names of the elements of the device 1400 may be changed. Also, the device 1400 according to the present exemplary embodiment may include at least one of the elements, and may omit some elements or may further include additional other elements.

According to an exemplary embodiment, an audio signal may be processed to be matched with a motion of an image based on informant of a planar image as well as a 3D image.

A method according to an exemplary embodiment may be embodied as computer-readable codes in a computer-readable recording medium. The computer-readable recording medium may be any recording apparatus capable of storing data that is read by a computer system. The computer-readable recording medium includes any storage device that may store data which may be read by a computer system. Examples of the computer-readable recording medium include ROMs, RAMs, CD-ROMs, magnetic tapes, floppy disks, and optical data storage devices.

While the inventive concept has been particularly shown and described with reference to exemplary embodiments thereof by using specific terms, the exemplary embodiments and terms have merely been used to explain the inventive concept and should not be construed as limiting the scope of the inventive concept as defined by the claims. The exemplary embodiments should be considered in a descriptive sense only and not for purposes of limitation. Therefore, the scope of the inventive concept is defined not by the detailed description of the inventive concept but by the appended claims, and all differences within the scope will be construed as being included in the inventive concept.

The invention claimed is:

1. A method of processing an audio signal comprising at least one audio object based on image information, the method comprising:

obtaining the audio signal and a current image that corresponds to the audio signal;

dividing the current image into at least one block;

obtaining motion information of the at least one block, the motion information comprising motion vectors associated with the at least one block;

generating index information comprising information for applying a three-dimensional (3D) effect in at least one direction to the at least one audio object, based on a central point on which directions of the motion vectors converge;

processing the at least one audio object included in the audio signal, in order to apply the 3D effect in the at least one direction to the at least one audio object, based on the index information; and outputting the audio signal including the processed audio object via a speaker.

2. The method of claim 1, wherein the generating of the index information comprises obtaining motion information of the current image based on the motion information about the at least one block, and generating the index information based on the motion information of the current image.

3. The method of claim 1, wherein the obtaining of the motion information of the at least one block comprises:

determining a block, having a lowest pixel value difference from each block of the current image, from among the at least one block that is included in an image that is prior or subsequent to the current image; and obtaining the motion information of the at least one block of the current image based on the block of the prior or subsequent image corresponding to each block of the current image.

4. The method of claim 1, wherein the obtaining of the motion information of the current image comprises:

when the motion information of the at least one block comprises a motion vector value, obtaining at least one representative value according to a distribution of motion vector values of the at least one block; and obtaining the motion information of the current image comprising the obtained at least one representative value.

5. The method of claim 4, wherein the motion information of the current image further comprises a reliability of the motion information of the current image that is determined according to a difference between the motion vectors of the at least one block, wherein the generating of the index information comprises determining the index information by determining a weight based on the reliability and applying the weight to the motion information of the current image.

6. The method of claim 1, wherein the index information is information for giving a 3D effect in at least one of left and right directions, up and down directions, and forward and backward directions to the at least one audio object, and comprises a sound panning index in the left and right directions, a depth index in the forward and backward directions, and a height index in the up and down directions.

7. The method of claim 6, wherein the generating of the index information comprises determining the depth index based on a change in a level of the audio signal.

8. The method of claim 6, wherein the generating of the index information comprises determining at least one of the depth index and the height index based on characteristics of a distribution of motion vector values of the at least one block.

9. The method of claim 1, wherein when the current image is a multi-view image comprising a plurality of images captured at the same time, the index information is determined based on motion information of at least one of the plurality of images.

10. The method of claim 9, further comprising obtaining disparity information of the current image comprising at least one of a maximum disparity value, a minimum disparity value, and position information of the current image having a maximum or minimum disparity according to divided regions of the current image, wherein the generating of the index information comprises determining a depth index in forward and backward directions based on the disparity information of the current image.

11. The method of claim 1, further comprising, when the audio signal does not comprise a top channel for outputting an audio signal having a height, generating an audio signal of the top channel based on a signal of a horizontal plane channel that is included in the audio signal.

12. The method of claim 1, wherein, when the at least one audio object and the current image are not matched with each other and/or when the at least one audio object is a non-effect sound, the index information is generated to reduce a 3D effect of the at least one audio object.

13. A device for processing an audio signal comprising at least one audio object, the device comprising:

a receiver configured to obtain the audio signal and a current image corresponding to the audio signal;

a controller configured to:

divide the current image into at least one block, obtain motion information of the at least one block, the motion information comprising motion vectors associated with the at least one block generate index information comprising information for applying a 3D effect in at least one direction to the at least one audio object based on a central point on which directions of the motion vectors converge, and process the at least one audio object included in the audio signal in order to apply the 3D effect in the at least one direction to the at least one audio object based on the index information; and a speaker configured to output the audio signal comprising the processed at least one audio object.

14. The device of claim 13, wherein, when the motion information of the at least one block comprises a motion vector value of each block, the controller obtains at least one representative value according to a distribution of motion vector values of one or more blocks and generates the index information based on the at least one representative value.

15. The device of claim 14, wherein the controller is further configured to determine the index information by determining a weight based on a reliability of motion information of the current image that is determined according to a difference between the motion vectors of the at least one block and applying the weight to the motion information of the current image.

* * * * *